US008064626B2

(12) United States Patent
Suzuki et al.

(10) Patent No.: US 8,064,626 B2
(45) Date of Patent: Nov. 22, 2011

(54) LOUDSPEAKER APPARATUS

(75) Inventors: Nobukazu Suzuki, Kanagawa (JP); Masaru Uryu, Chiba (JP); Yoshio Ohashi, Kanagawa (JP); Yukio Tanaka, Tokyo (JP); Nobuyuki Nishigori, Tokyo (JP)

(73) Assignee: Sony Corporation, Tokyo (JP)

( * ) Notice: Subject to any disclaimer, the term of this patent is extended or adjusted under 35 U.S.C. 154(b) by 493 days.

(21) Appl. No.: 12/349,654

(22) Filed: Jan. 7, 2009

(65) Prior Publication Data

US 2009/0175471 A1 Jul. 9, 2009

(30) Foreign Application Priority Data

Jan. 9, 2008 (JP) ..... 2008-001908

(51) Int. Cl.
*H04R 15/00* (2006.01)

(52) U.S. Cl. ..... 381/336; 381/396

(58) Field of Classification Search ..... 438/336, 438/334, 396, 388, 395, 87
See application file for complete search history.

(56) References Cited

U.S. PATENT DOCUMENTS

| | | | | |
|---|---|---|---|---|
| 7,610,991 | B2 * | 11/2009 | Suzuki et al. | 181/153 |
| 2007/0133837 | A1 * | 6/2007 | Suzuki et al. | 381/396 |
| 2007/0223734 | A1 * | 9/2007 | Suzuki et al. | 381/96 |
| 2008/0175416 | A1 * | 7/2008 | Suzuki et al. | 381/152 |
| 2009/0208039 | A1 * | 8/2009 | Suzuki et al. | 381/190 |

FOREIGN PATENT DOCUMENTS

| | | | |
|---|---|---|---|
| JP | 2005-311481 | A | 11/2005 |
| JP | 2007-166027 | A | 6/2007 |

* cited by examiner

*Primary Examiner* — Savitr Mulpuri
(74) *Attorney, Agent, or Firm* — Wolf, Freenfield & Sacks, P.C.

(57) ABSTRACT

A loudspeaker apparatus includes an acoustic diaphragm; a support member having a housing, which is a hole in a surface of the support member facing the acoustic diaphragm; a magnetostrictive actuator having a magnetostrictor and a drive rod coupled to an end of the magnetostrictor, the magnetostrictive actuator being inserted into the housing such that the drive rod contacts the acoustic diaphragm, the magnetostrictive actuator applying vibration to the acoustic diaphragm; and a spring inserted into the housing from a position opposite to a position of the drive rod of the magnetostrictive actuator, the spring pressing the magnetostrictive actuator toward the acoustic diaphragm and applying a load to the magnetostrictor.

8 Claims, 9 Drawing Sheets

LOUDSPEAKER APPARATUS

CROSS REFERENCES TO RELATED APPLICATIONS

The present invention contains subject matter related to Japanese Patent Application JP 2008-001908 filed in the Japanese Patent Office on Jan. 9, 2008, the entire contents of which are incorporated herein by reference.

BACKGROUND OF THE INVENTION

1. Field of the Invention

The present invention relates to a loudspeaker apparatus that reproduces sound by applying vibration to an acoustic diaphragm by a magnetostrictive actuator.

2. Description of the Related Art

A loudspeaker apparatus that reproduces sound by applying vibration to an acoustic diaphragm by a magnetostrictive actuator has been suggested.

In particular, Japanese Unexamined Patent Application Publication No. 2007-166027 discloses as shown in, for example, FIG. 8, a configuration in which a cylindrical acoustic diaphragm 110 made of acryl or the like is vertically supported, a plurality of magnetostrictive actuators 130 are arranged at a lower end of the acoustic diaphragm 110, and drive rods 135 of the magnetostrictive actuators 130 contact a lower end surface 112 of the acoustic diaphragm 110, to apply vibration to the acoustic diaphragm 110 in a direction perpendicular to the lower end surface 112, or in a plate-face direction.

In this case, the lower end surface 112 of the acoustic diaphragm 110 is excited with a longitudinal wave. As a vibration elastic wave is propagated in the plate-face direction of the acoustic diaphragm 110, a transversal wave is generated in addition to the longitudinal wave. The transversal wave causes an acoustic wave to be radiated in a direction perpendicular to a plate face of the acoustic diaphragm 110, thereby providing a widely spread sound field.

The magnetostrictive actuator is an actuator using a magnetostrictor the shape of which is changed when an external magnetic field is applied. A giant magnetostrictor is recently available, a deformation thereof being as approximately thousand times large as a deformation of a magnetostrictor in the past. In addition, the magnetostrictor generates a large stress when the shape is changed. Even when the magnetostrictive actuator is small, the magnetostrictive actuator can cause the acoustic diaphragm to produce relatively laud sound, and the magnetostrictive actuator can cause a hard acoustic diaphragm made of, for example, an iron plate to produce sound.

Further, the magnetostrictive actuator has a high response speed. The response speed of a single magnetostrictor is based on a nanosecond order.

SUMMARY OF THE INVENTION

A support structure for the magnetostrictive actuator 130 of the loudspeaker apparatus shown in FIG. 8 may be a structure shown in FIG. 9.

In particular, when the acoustic diaphragm 110 is cylindrical, a disk-like base casing 120 having a certain height (thickness) and an outer diameter larger than an outer diameter of the acoustic diaphragm 110 is provided. A lower end portion of the acoustic diaphragm 110 is mounted on the base casing 120 by mounting tools such as L-shaped plates (not illustrated in FIG. 9) at four equiangular positions on an upper surface 121 of the base casing 120.

Housings 123 are formed in the base casing 120 at four equiangular positions between the above-mentioned mounting positions. The housings 123 are through holes penetrating through the base casing 120 in a vertical direction from the upper surface 121 to a lower surface 122. The magnetostrictive actuators 130 are respectively inserted into the housings 123 from the lower side such that the drive rods 135 face upward.

In addition, a leaf spring 151 is attached to the lower surface 122 of the base casing 120 by screws 152 and 153 such that the magnetostrictive actuators 130 respectively inserted into the housings 123 are supported and the tip ends of the drive rods 135 contact the lower end surface 112 of the acoustic diaphragm 110.

Each magnetostrictive actuator 130 includes an actuator body and an outer casing 139. The actuator body includes a rod-like magnetostrictor 131, a solenoid coil 132 arranged around the magnetostrictor 131, a magnet 133 and a yoke 134 arranged around the solenoid coil 132, the drive rod 135 coupled to an end of the magnetostrictor 131, and a fixed plate 136 attached to another end of the magnetostrictor 31. The actuator body is disposed in the outer casing 139 such that a tip end portion of the drive rod 135 protrudes outward from the outer casing 139.

A damping member 137 made of silicon rubber or the like is arranged at the drive rod 135. A screw 138 is inserted toward the back side of the fixed plate 136, and hence a preload F1 is applied to the magnetostrictor 131.

By applying the preload F1 to the magnetostrictor 131 in the magnetostrictive actuator 130, the magnetostrictor 131 can be prevented from being broken as a result of a repeated stress when the magnetostrictive actuator 130 is driven.

When a controlling current is supplied to the solenoid coil 132 and a controlling magnetic field is applied to the magnetostrictor 131, a characteristic of a magnetostriction value with respect to the controlling magnetic field is markedly changed in accordance with a load to be applied to the magnetostrictor 131. When a certain load is applied, a magnetic field range, in which the magnetostriction value is linearly changed with respect to a change in controlling magnetic field, becomes the widest, and a change in magnetostriction value with respect to the change in controlling magnetic field within the magnetic field range becomes the largest.

Accordingly, the load at this time is determined to an optimal value, and the characteristic of the magnetostriction value with respect to the controlling magnetic field at this time is determined to an optimal magnetostrictive characteristic.

In particular, for example, when a load to be applied to the magnetostrictor 131 is 105 kg/cm$^2$, the magnetic field range, in which the magnetostriction value is linearly changed with respect to the change in controlling magnetic field, becomes the widest, and the change in magnetostriction value with respect to the change in controlling magnetic field within the magnetic field range becomes the largest.

Regarding this, in the magnetostrictive actuator 130, the degree of fastening the screw 138 is adjusted such that the preload F1 becomes the optimal value of 105 kg/cm$^2$, or that a load of 3.30 kg is applied to the magnetostrictor 131, for example, when the magnetostrictor 131 has a diameter of 2 mm, and a cross-sectional area of 3.14 mm$^2$.

However, with the configuration shown in FIG. 9, when variations in size and adjustment appear among manufactured multiple loudspeaker apparatuses, or among a plurality of magnetostrictive actuators or housings of a single loudspeaker apparatus, a load to be applied to the magnetostrictor 131 may be markedly changed, resulting in the magnetostrictive characteristic being markedly changed.

For example, when a total length of the magnetostrictive actuator 130 (length from a tip end of the drive rod 135 to a bottom surface of the screw 138) is smaller than a design value, or when a distance from the lower end surface 112 of the acoustic diaphragm 110 to the lower surface 122 of the base casing 120 is larger than a design value, a contact pressure of the drive rod 135 against the acoustic diaphragm 110 is decreased, and a small gap may be occasionally generated between the tip end of the drive rod 135 and the lower end surface 112 of the acoustic diaphragm 110.

Thus, although the preload F1 is determined to the above-described optimal value, the load to be applied to the magnetostrictor 131 becomes smaller than the optimal value, resulting in the magnetostrictive characteristic being deviated from the above-described optimal magnetostrictive characteristic.

On the other hand, when the total length of the magnetostrictive actuator 130 is larger than the design value, or when the distance from the lower end surface 112 of the acoustic diaphragm 110 to the lower surface 122 of the base casing 120 is smaller than the design value, a load larger than the preload F1 is applied to the magnetostrictor 131 because the leaf spring 151 presses the magnetostrictive actuator 130 toward the acoustic diaphragm 110.

Thus, although the preload F1 is determined to the above-described optimal value, the load to be applied to the magnetostrictor 131 becomes larger than the optimal value, resulting in the magnetostrictive characteristic being deviated from the above-described optimal magnetostrictive characteristic.

Also, with the configuration shown in FIG. 9, when the magnetostrictive actuator 130 is driven for a long time such as 1000 hours or longer, and hence a portion of the lower end surface 112 of the acoustic diaphragm 110, the portion contacting the drive rod 135, is subjected to wear, the same result is obtained as that of the above-described case in which the distance from the lower end surface 112 of the acoustic diaphragm 110 to the lower surface 122 of the base casing 120 is longer than the design value.

Further, with the configuration shown in FIG. 9, if the degree of fastening the screw 152 is different from that of the screw 153, such as a situation in which the screw 152 is loosely fastened and the screw 153 is tightly fastened, an axial direction of the magnetostrictive actuator 130 is inclined with respect to a vertical direction, and a direction in which vibration is applied to the acoustic diaphragm 110 and a magnitude of the vibration become different from expected direction and magnitude. Thus, expected sound quality and volume are not provided.

In light of this, it is desirable to provide a loudspeaker apparatus that reproduces sound by applying vibration to an acoustic diaphragm by a magnetostrictive actuator, the loudspeaker apparatus being capable of constantly providing a desirable magnetostrictive characteristic and providing predetermined sound quality and volume, regardless of variations in size and adjustment of magnetostrictive actuators and support members and regardless of wear of the acoustic diaphragm.

A loudspeaker apparatus according to an embodiment of the present invention includes an acoustic diaphragm; a support member having a housing, which is a hole in a surface of the support member facing the acoustic diaphragm; a magnetostrictive actuator having a magnetostrictor and a drive rod coupled to an end of the magnetostrictor, the magnetostrictive actuator being inserted into the housing such that the drive rod contacts the acoustic diaphragm, the magnetostrictive actuator applying vibration to the acoustic diaphragm; and a spring inserted into the housing from a position opposite to a position of the drive rod of the magnetostrictive actuator, the spring pressing the magnetostrictive actuator toward the acoustic diaphragm and applying a load to the magnetostrictor.

With the loudspeaker apparatus of the above configuration, a force of the spring pressing the magnetostrictive actuator toward the acoustic diaphragm is increased within a desirable range in a situation, and the force of the spring pressing the magnetostrictive actuator toward the acoustic diaphragm is decreased within the desirable range in another situation, depending on the variations in size and adjustment of magnetostrictive actuators and support members and depending on the wear of the acoustic diaphragm. That is, a load to be applied to the magnetostrictor is increased or decreased within the desirable range, and the magnetostrictive characteristic is changed within the desirable range.

Accordingly, the desirable magnetostrictive characteristic can be constantly provided, and the predetermined sound quality and volume can be provided, regardless of the variations in size and adjustment of magnetostrictive actuators and support members, and regardless of the wear of the acoustic diaphragm.

In addition, since the spring is inserted into the housing and presses the center of the magnetostrictive actuator toward the acoustic diaphragm, the axial direction of the magnetostrictive actuator is not inclined with respect to the expected direction, or the direction and magnitude of the vibration to be applied to the acoustic diaphragm are not differentiated from the expected direction and magnitude.

As described above, with this configuration, the desirable magnetostrictive characteristic can be constantly provided, and the predetermined sound quality and volume can be provided, regardless of the variations in size and adjustment of magnetostrictive actuators and support members, and regardless of the wear of the acoustic diaphragm.

DESCRIPTION OF THE PREFERRED EMBODIMENTS

1. First Embodiment: FIGS. 1 to 5

In a first embodiment, a through hole is formed as a housing in a base casing as a support member, and a magnetostrictive actuator, a coil spring as an example of a spring, and a member for compressing the coil spring are disposed in the hole.

Figure 1A:
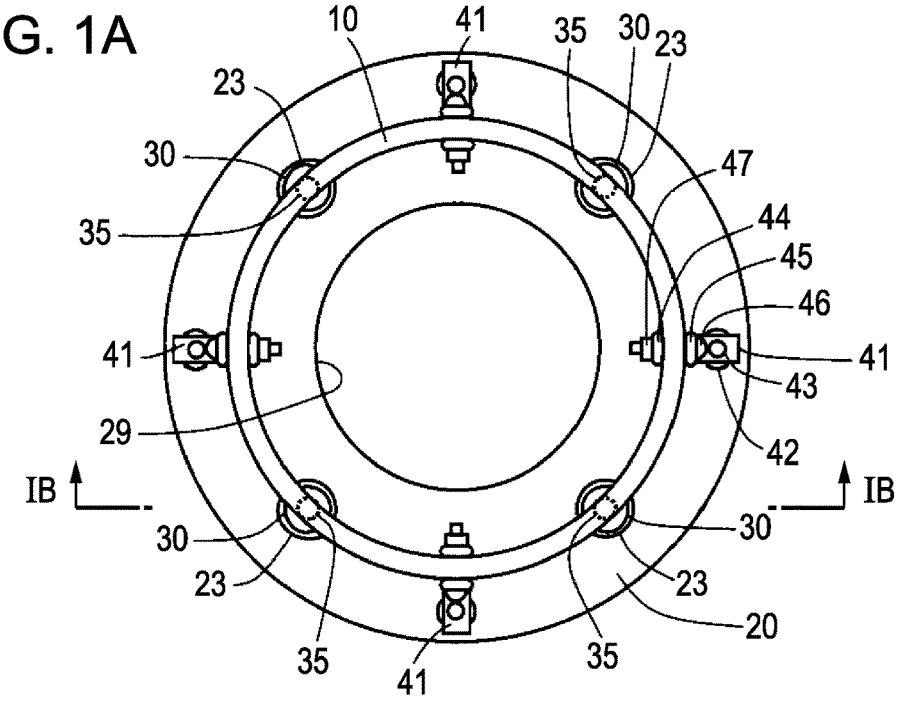
FIGS. 1A and 1B illustrate an example general configuration of a loudspeaker apparatus according to a first embodiment.
Figure 1B:
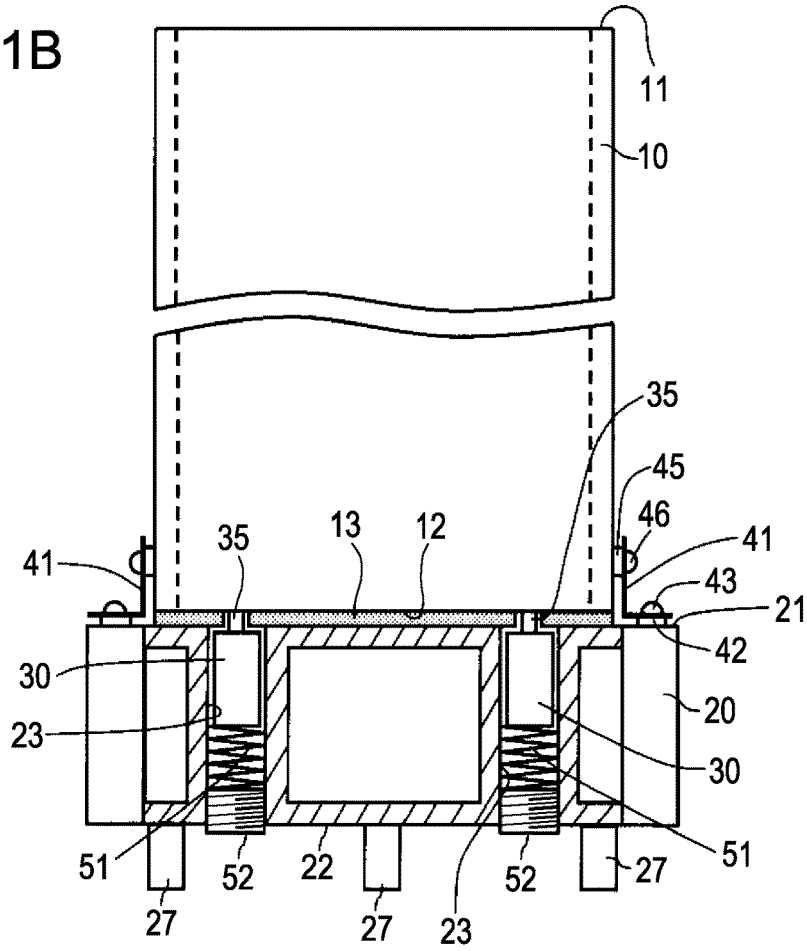

1-1. Example General Configuration of Loudspeaker Apparatus: FIGS. 1A and 1B FIGS. 1A and 1B illustrate an example of the loudspeaker apparatus according to the first embodiment. In particular, FIG. 1A is a top view (when viewed from the upper side), and FIG. 1B is a side view involving a cross-sectional view for the base casing as the support member taken along line IB-IB in FIG. 1A.

An acoustic diaphragm 10 is, for example, an open-ended acrylic cylinder with a thickness of 2 mm, a diameter of 10 cm, and a length (height) of 100 cm.

A base casing 20 is, for example, an aluminum disk with a certain height (thickness) and an outer diameter larger than an outer diameter of the acoustic diaphragm 10.

The acoustic diaphragm 10 has an upper end surface 11 at an end surface at a side, and a lower end surface 12 at an end surface at another side. It is assumed that an axial direction of the acoustic diaphragm 10 is a vertical direction. The acoustic diaphragm 10 is mounted on an upper surface 21 of the base casing 20 such that a center axis of the acoustic diaphragm 10 is aligned with a center axis of the base casing 20.

In particular, L-shaped plates 41 are provided at four equiangular positions on the upper surface 21 of the base casing 20. An end of each L-shaped plate 41 is attached to the base casing 20 by a screw 43 with a damping member 42 arranged between the L-shaped plate 41 and the base casing 20. Another end of each L-shaped plate 41 is attached to a lower end portion of the acoustic diaphragm 10 by a screw 46 and a nut 47 with a damping member 44 arranged between the inner side of the acoustic diaphragm 10 and the nut 47 and with a damping member 45 arranged between the outer side of the acoustic diaphragm 10 and the screw 46. The damping members 42, 44, and 45 are made of silicon rubber.

By mounting the acoustic diaphragm 10 on the base casing 20 via the damping members 44, 45, and 42, vibration of the acoustic diaphragm 10 is prevented from being propagated to the base casing 20, and hence, a sound image can be prevented from being localized at the base casing 20.

In addition, housings 23 are formed in the base casing 20 at four equiangular positions between the mounting positions of the L-shaped plates 41. The housings 23 are through holes penetrating through the base casing 20 in the vertical direction from the upper surface 21 to a lower surface 22.

Magnetostrictive actuators 30 are respectively inserted into the housings 23 of the base casing 20 from the lower side of the housings 23 such that drive rods 35 face upward. Then, coil springs 51 and screws 52 are respectively inserted to the lower sides of the magnetostrictive actuators 30 in the housings 23.

Each screw 52 is inserted into the housing 23 to a position at which a tip end of the drive rod 35 contacts the lower end surface 12 of the acoustic diaphragm 10 and the coil spring 51 is compressed by a predetermined amount.

Legs 27 are formed at three equiangular positions on the lower surface 22 of the base casing 20.

In addition, if necessary, a damping member 13 made of silicon rubber or the like may be arranged between the lower end surface 12 of the acoustic diaphragm 10 and the upper surface 21 of the base casing 20 in an area not occupied by the drive rods 35 of the magnetostrictive actuators 30, in order to increase the degree of sealing between the acoustic diaphragm 10 and the base casing 20.

With the loudspeaker apparatus according to the example shown in FIGS. 1A and 1B having the above configuration, when the magnetostrictive actuators 30 are driven with an audio signal, magnetostrictors (described later) of the magnetostrictive actuators 30 are expanded or contracted in an axial direction thereof in accordance with the audio signal. The drive rods 35 are displaced in the same direction, and hence, vibration with a longitudinal wave is applied to the lower end surface 12 of the acoustic diaphragm 10.

The longitudinal wave is propagated to the upper end surface 11 along a plate face of the acoustic diaphragm 10. During the propagation, a transversal wave is generated in addition to the longitudinal wave. The transversal wave is radiated as an acoustic wave in a direction perpendicular to the plate face of the acoustic diaphragm 10.

Accordingly, a sound image is spread evenly in the entire plate face of the acoustic diaphragm 10, and the sound image is uniformly located in the entire acoustic diaphragm 10.

When the magnetostrictive actuators 30 are driven with the same audio signal, non-directivity can be obtained. When the magnetostrictive actuators 30 are driven with audio signals of different channels, or with audio signals acquired from the same audio signal but having different levels, different delay times, or different frequency characteristics, a widely spread sound field can be obtained.

Referring to FIG. 1A, an opening 29 may be formed at a center portion of the base casing 20, and a loudspeaker unit of a dynamic loudspeaker may be mounted to the opening 29 such that a front side of the loudspeaker faces downward. For example, the acoustic diaphragm 10 and the magnetostrictive actuators 30 may serve as a tweeter for a high-frequency part of an audible frequency range, and the dynamic loudspeaker may serve as a woofer for a low-frequency part of the audible frequency range.

Figure 2:
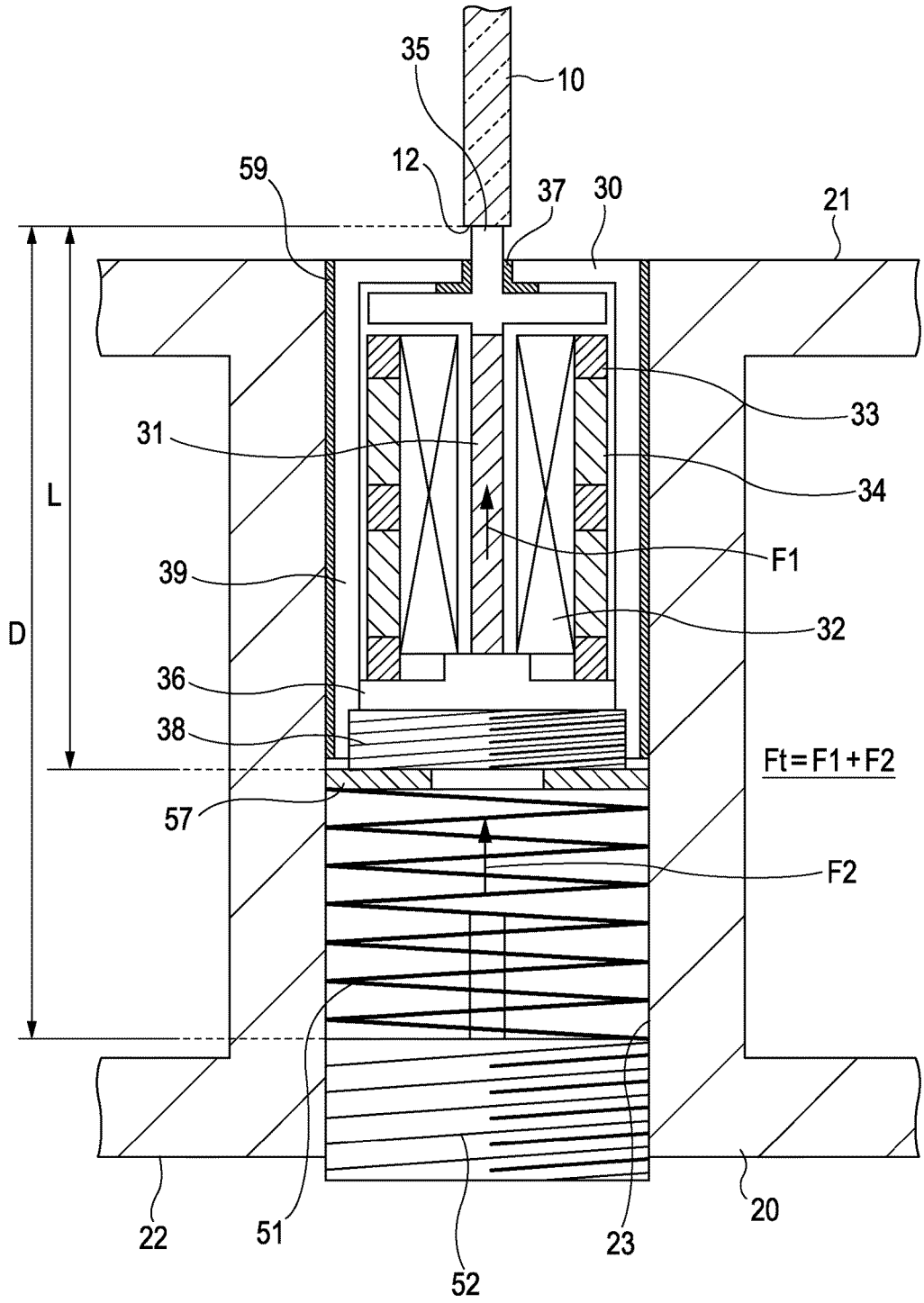
FIG. 2 illustrates a primary portion of a loudspeaker apparatus as a first example according to the first embodiment.
Figure 3:
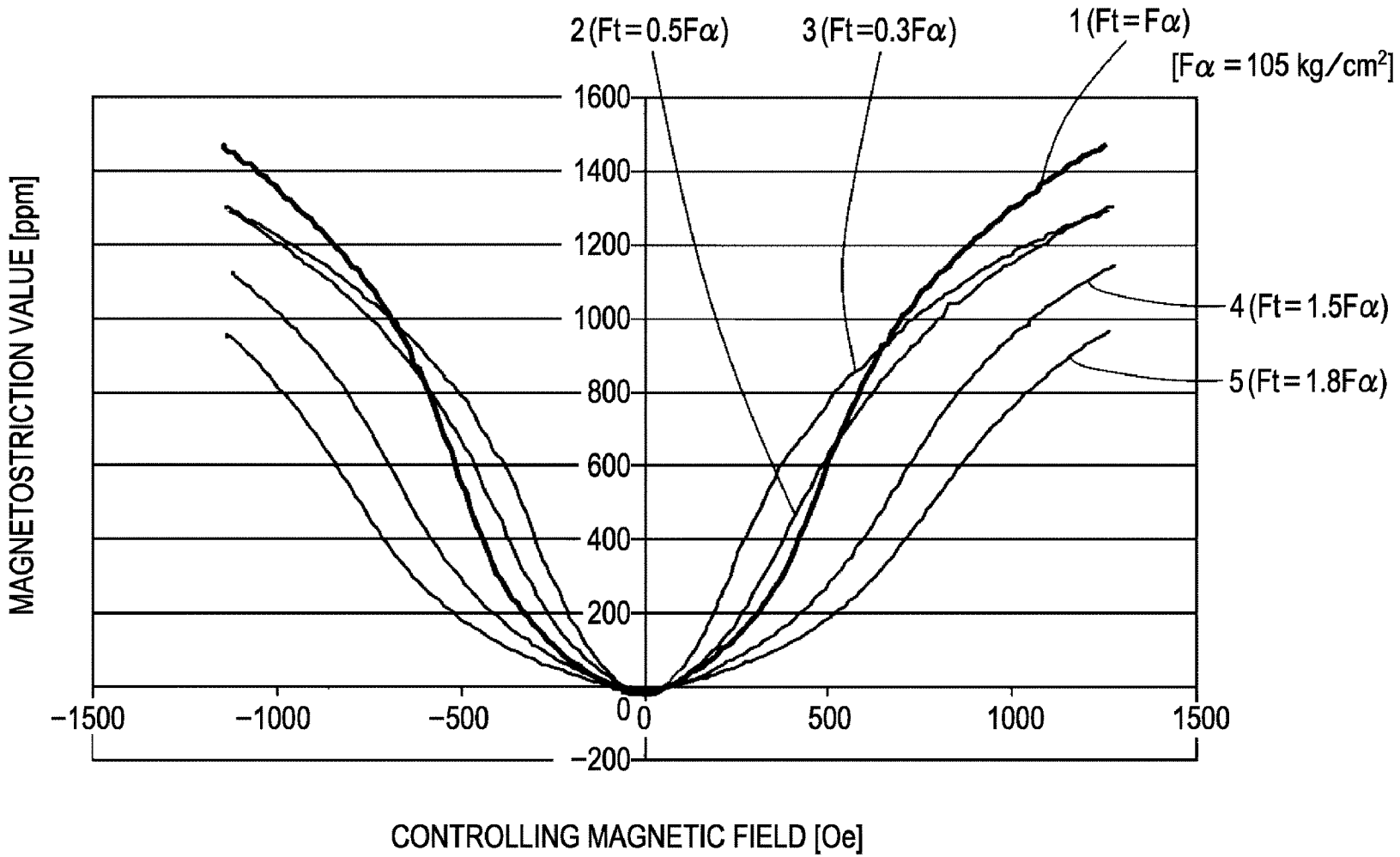
FIG. 3 illustrates an example characteristic of a magnetostriction value with respect to a controlling magnetic field.
Figure 4:
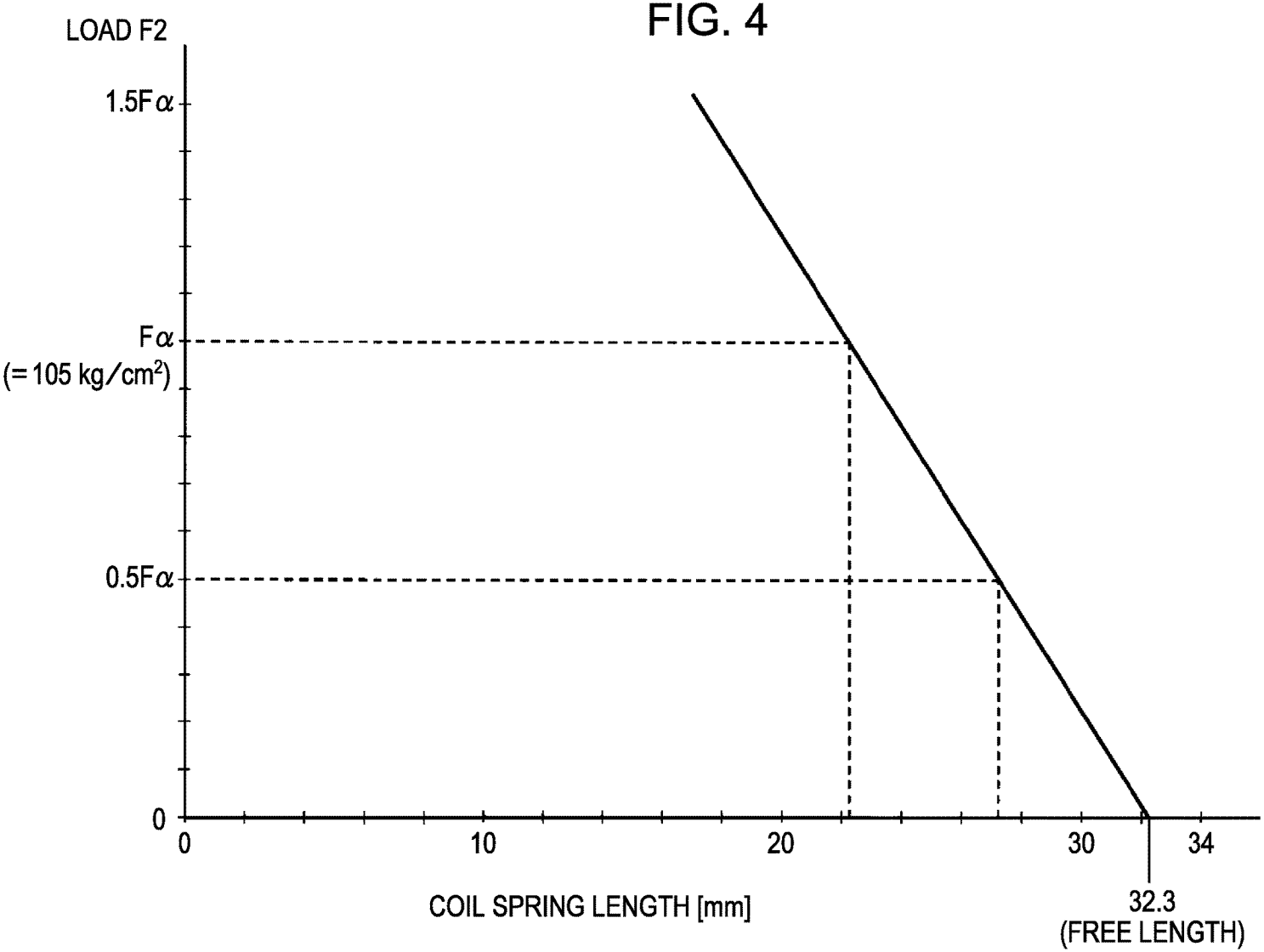
FIG. 4 illustrates an example relationship between a contraction amount of a coil spring and a load applied by the coil spring in the first example shown in FIG. 2.

1-2. First Example: FIGS. 2 to 4

In a first example according to the first embodiment, a preload is applied to the magnetostrictive actuator.

<Configuration: FIG. 2>

FIG. 2 illustrates a condition in which the magnetostrictive actuators 30, the coil springs 51, and the screws 52 are respectively disposed in the housings 23 of the base casing 20 of the loudspeaker apparatus in the example shown in FIG. 1.

Each magnetostrictive actuator 30 includes an actuator body and an outer casing 39 made of, for example, aluminum. The actuator body includes a rod-like magnetostrictor 31, a solenoid coil 32 arranged around the magnetostrictor 31, a magnet 33 and a yoke 34 arranged around the solenoid coil 32, the drive rod 35 coupled to an end of the magnetostrictor 31, and a fixed plate 36 attached to another end of the magnetostrictor 31. The actuator body is disposed in the outer casing 39 such that a tip end portion of the drive rod 35 protrudes outward from the outer casing 39.

A damping member 37 made of silicon rubber or the like is arranged at the drive rod 35. A screw 38 is inserted toward the back side of the fixed plate 36, and hence a preload F1 is applied to the magnetostrictor 31.

The magnetostrictive actuator 30 with the preload F1 applied in this way is advantageous to preventing the magnetostrictor 31 from being broken in such a situation in which the magnetostrictive actuator 30 and the loudspeaker apparatus are manufactured by different makers (manufacturers) and the maker who produced the magnetostrictive actuator 30 tests the produced magnetostrictive actuator 30.

When an audio signal is supplied to the solenoid coil 32 and the magnetostrictive actuator 30 is driven with the audio signal, sound with a higher frequency is reproduced as the magnetostrictor 31 becomes thinner. Hence, the diameter of the magnetostrictor 31 is decreased to, for example, 2 mm.

In the example shown in FIG. 2, as described above, while the acoustic diaphragm 10 is supported by the base casing 20, the magnetostrictive actuators 30 of the above configuration are inserted into the housings 23, the coil springs 51 are also inserted into the housings 23, and then the screws 52 are inserted into the housings 23 to positions at which the coil springs 51 are compressed, the tip ends of the drive rods 35 contact the lower end surface 12 of the acoustic diaphragm 10, and the coil springs 51 apply a load F2 to the magnetostrictors 31 in addition to the above-mentioned preload F1.

At this time, if an end (upper end portion) of each coil spring 51 directly contacts the screw 38 at a bottom portion of the magnetostrictive actuator 30, the coil spring 51 may be rotated with the screw 52 when the screw 52 is rotated and inserted into the housing 23. Thus, a torsion stress may be applied to the magnetostrictor 31 of the magnetostrictive actuator 30, possibly resulting in the magnetostrictor 31 being broken.

Therefore, a ring 57 may be inserted between the magnetostrictive actuator 30 and the coil spring 51 as illustrated. The ring 57 is made of, for example, metal or polyethylene terephthalate (PET), so that the coil spring 51 does not receive a resistance and is smoothly rotated.

Accordingly, when the screw 52 is rotated and inserted into the housing 23 and hence the coil spring 51 is rotated with the screw 52, the coil spring 51 does not receive a resistance and is smoothly rotated. Thus, no torsion stress is applied to the magnetostrictor 31, thereby preventing the magnetostrictor 31 from being broken.

Further, at this time, when the magnetostrictive actuator 30 is driven and vibration is applied to the acoustic diaphragm 10, the outer casing 39 of the magnetostrictive actuator 30 may contact the base casing 20 at an inner peripheral surface of the housing 23. This may cause the outer casing 39 or the base casing 20 to be subjected to damage or wear.

Therefore, a thin film 59, such as lubricating oil, may be formed or arranged between an outer peripheral surface of the outer casing 39 and the inner peripheral surface of the housing 23 of the base casing 20 as illustrated. The thin film 59 prevents the outer casing 39 and the base casing 20 from directly contacting each other without affecting the driving of the magnetostrictive actuator 30.

<Magnetostrictive Characteristic and Load: FIGS. 3 and 4>

In the example shown in FIG. 2, a total load Ft (=F1+F2), or the sum of the preload F1 and the load F2, is determined to an optimal value as described below.

When a controlling current is supplied to the solenoid coil 32 and a controlling magnetic field is applied to the magnetostrictor 31, a characteristic of a magnetostriction value with respect to the controlling magnetic field is changed in accordance with the total load Ft, for example, as shown in FIG. 3.

Illustrated in FIG. 3 are:

(a) curve 1 when a total load Ft is $F\alpha=105$ kg/cm$^2$, (b) curve 2 when a total load Ft is $0.5F\alpha=52.5$ kg/cm$^2$, (c) curve 3 when a total load Ft is $0.3F\alpha=31.5$ kg/cm$^2$, (d) curve 4 when a total load Ft is $1.5F\alpha=157.5$ kg/cm$^2$, and (e) curve 5 when a total load Ft is $1.8F\alpha=189$ kg/cm$^2$.

The total load Ft is a load per a unit area (1 cm$^2$). For example, it is assumed that the magnetostrictor 31 has a diameter of 2 mm and a cross-sectional area of 3.14 mm$^2$.

Therefore, total loads Gt to be actually applied to the magnetostrictor 31 are:

(f) $G\alpha=3.30$ kg in curve 1, (g) $0.5G\alpha=1.65$ kg in curve 2, (h) $0.3G\alpha=0.99$ kg in curve 3, (i) $1.5G\alpha=4.95$ kg in curve 4, and (j) $1.8G\alpha=5.94$ kg in curve 5.

As shown in curve 1, when the total load Ft is $F\alpha=105$ kg/cm$^2$ (when the total load Gt is $G\alpha=3.30$ kg), a magnetic field range, in which a magnetostriction value is linearly changed with respect to a change in controlling magnetic field, becomes the widest, and a change in magnetostriction value with respect to the change in controlling magnetic field within the magnetic field range becomes the largest.

Hence, $F\alpha=105$ kg/cm$^2$, or $G\alpha=3.30$ kg is determined to an optimal value. Determining the total load Ft to the optimal value $F\alpha$, and a bias magnetic field to about 500 Oe, when the audio signal is supplied to the solenoid coil 32 and the controlling magnetic field is applied to the magnetostrictor 31, an optimal magnetostrictive characteristic can be obtained.

Though not shown in FIG. 3, even when the total load Ft is smaller than $F\alpha=105$ kg/cm$^2$, as long as the total load Ft is equal to or larger than 80 kg/cm$^2$, the magnetic field range, in which the magnetostriction value is linearly changed with respect to the change in controlling magnetic field, is wide, and the change in magnetostriction value with respect to the change in controlling magnetic field within the magnetic field range is large, as compared with the cases of curves 2 and 3.

On the other hand, even when the total load Ft is larger than $F\alpha=105$ kg/cm$^2$, as long as the total load Ft is equal to or smaller than 110 kg/cm$^2$, the magnetic field range, in which the magnetostriction value is linearly changed with respect to the change in controlling magnetic field, is wide, and the change in magnetostriction value with respect to the change in controlling magnetic field within the magnetic field range is large, as compared with the cases of curves 4 and 5.

Thus, a desirable range of the total load Ft for the driving of the magnetostrictive actuator 30 may be from 80 to 110 kg/cm$^2$, or a desirable range of the total load Gt may be from 2.51 to 3.45 kg when the total load Ft is converted into the total load Gt.

The total load Ft is determined to the optimal value $F\alpha$. For example, the optimal value $F\alpha$ is divided into halves and distributed into the preload F1 and the load F2 by $0.5F\alpha=52.5$ kg/cm$^2$ each.

That is, in the magnetostrictive actuator 30, the screw 38 applies a torque corresponding to $F1=0.5F\alpha=52.5$ kg/cm$^2$ to the magnetostrictor 31. When the torque is converted into a preload G1 which is actually applied to the magnetostrictor 31, the preload G1 is $G1=0.5G\alpha=1.65$ kg.

Regarding the load F2, the screw 52 compresses the coil spring 51, and hence a load, which is $F2=0.5F\alpha=52.5$ kg/cm$^2$, is applied to the magnetostrictor 31. When the torque is converted into a preload G2 which is actually applied to the magnetostrictor 31, the preload G2 is $G2=0.5G\alpha=1.65$ kg.

For example, the coil spring 51 having a free length of 32.3 mm and a spring constant ranging from 0.2 to 0.3 kgf/mm is used. Referring to FIG. 4, the coil spring 51 is compressed by about 5 mm from the free length of 32.3 mm, so that the load F2 becomes $F2=0.5F\alpha=52.5$ kg/cm$^2$.

Accordingly, in the example shown in FIG. 2, the components, such as the magnetostrictive actuator 30 and the base casing 20, and the members, such as the coil spring 51 and the screw 52, are designed and fabricated, and then the loudspeaker apparatus is assembled such that the preload F1 of the magnetostrictive actuator 30 becomes $0.5F\alpha=52.5$ kg/cm$^2$, the load F2 becomes $0.5F\alpha=52.5$ kg/cm$^2$ by inserting the screw 52 into the housing 23 to a position at which the coil spring 51 is compressed by about 5 mm, and the total load Ft (=F1+F2) becomes Fα=105 kg/cm$^2$.

Herein, even when variations in size and adjustment appear among manufactured multiple loudspeaker apparatuses, or among a plurality of magnetostrictive actuators or housings of a single loudspeaker apparatus, the variations are absorbed by a variation in contraction amount of the coil spring 51.

For example, when a total length L of the magnetostrictive actuator 30 (length from a tip end of the drive rod 35 to a bottom surface of the screw 38) is smaller than a design value, or when a distance D from the lower end surface 12 of the acoustic diaphragm 10 to an upper surface of the screw 52 is larger than a design value, the contraction amount of the coil spring 51 becomes smaller than a design value. At this time, the total load Ft becomes smaller than the optimal value Fα; however, the decrement is very small. The total load Ft is within the above-described range of from 80 to 110 kg/cm$^2$.

On the other hand, when the total length L of the magnetostrictive actuator 30 is larger than the design value, or when the distance D is smaller than the design value, the contraction amount of the coil spring 51 becomes larger than the design value. At this time, the total load Ft becomes larger than the optimal value Fα; however, the increment is very small. The total load Ft is within the above-described range of from 80 to 110 kg/cm$^2$.

Accordingly, with the example shown in FIG. 2, the total load Ft falls within the desired range, regardless of the variations in size and adjustment. The magnetostrictive actuator 30 can be constantly driven with a desirable magnetostrictive characteristic with the wide magnetic field range, in which the magnetostriction value is linearly changed with respect to the change in controlling magnetic field, and with the large change in magnetostriction value with respect to the change in controlling magnetic field within the magnetic field range.

When the magnetostrictive actuator 30 is driven for a long time, a portion of the lower end surface 12 of the acoustic diaphragm 10, the portion contacting the drive rod 35, may be subjected to wear. In a test, when the acoustic diaphragm 10 was made of acryl, the drive rod 35 was made of iron, a sound signal with a peak voltage ranging from 6 to 7 Vrms was applied to the solenoid coil 32, and the magnetostrictive actuator 30 was driven for 1000 hours, the portion of the lower end surface 12 of the acoustic diaphragm 10, the portion contacting the drive rod 35, was subjected to wear by about 10 μm.

In the example shown in FIG. 2, even when the portion of the lower end surface 12 of the acoustic diaphragm 10, the portion contacting the drive rod 35, is subjected to wear through the long-time use, the wear amount is very small. Thus, similarly to the above-described case in which the distance D is larger than the design value, the total load Ft falls within the above-described range of from 80 to 110 kg/cm$^2$, and hence the magnetostrictive actuator 30 can be driven with the above-described desirable magnetostrictive characteristic.

Also, in the example shown in FIG. 2, the coil spring 51 presses the center of the magnetostrictive actuator 30 toward the acoustic diaphragm 10. Accordingly, the axial direction of the magnetostrictive actuator 30 is not inclined with respect to the vertical direction. Vibration with a uniform magnitude in a uniform direction is constantly applied to the acoustic diaphragm 10.

Figure 5:
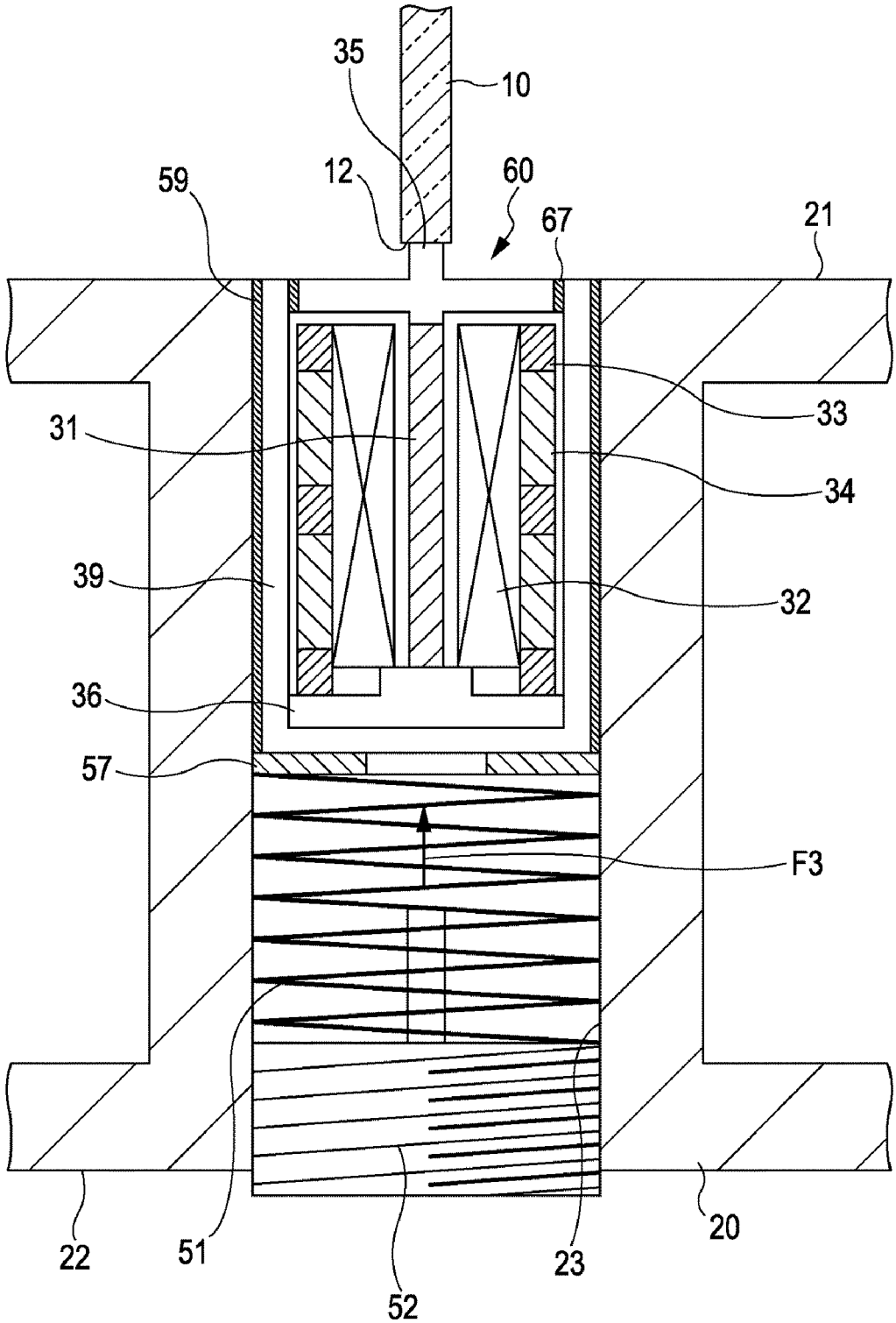
FIG. 5 illustrates a primary portion of a loudspeaker apparatus as a second example according to the first embodiment.

1-3. Second Example: FIG. 5

A magnetostrictive actuator with no preload applied may be used.

FIG. 5 illustrates that example as a second example according to the first embodiment. The acoustic diaphragm 10 and its support structure are similar to those in the example shown in FIG. 1.

A magnetostrictive actuator 60 of the example shown in FIG. 5, similarly to the magnetostrictive actuator 30 of the example shown in FIG. 2, includes an actuator body and an outer casing 39 made of, for example, aluminum. The actuator body includes a rod-like magnetostrictor 31, a solenoid coil 32 arranged around the magnetostrictor 31, a magnet 33 and a yoke 34 arranged around the solenoid coil 32, a drive rod 35 coupled to an end of the magnetostrictor 31, and a fixed plate 36 attached to another end of the magnetostrictor 31. The actuator body is disposed in the outer casing 39 such that a tip end portion of the drive rod 35 protrudes outward from the outer casing 39. However, unlike the magnetostrictive actuator 30 of the example shown in FIG. 2, the magnetostrictive actuator 60 does not have the above-described screw 38 or the damping member 37, and hence no preload is applied to the magnetostrictor 31.

In this case, to resist a transversal stress, for example, an O-ring 67 is provided between a disk portion of the drive rod 35 and the outer casing 39.

The magnetostrictive actuator 60 with no preload applied does not use a member for applying a preload, such as the above-described screw 38 and the damping member 37. Hence, the structure of the magnetostrictive actuator 60 is simple.

In this example, as described above, while the acoustic diaphragm 10 is supported by the base casing 20, the magnetostrictive actuators 60 of the above configuration are inserted into the housings 23 such that the drive rods 35 face upward, the ring 57 and the coil springs 51 are also inserted into the housings 23, and then the screws 52 are inserted into the housings 23 to positions at which the coil springs 51 are compressed, the tip ends of the drive rods 35 contact the lower end surface 12 of the acoustic diaphragm 10, and the coil springs 51 apply a load F3 to the magnetostrictors 31.

In this example, the load F3 applied by the coil springs 51 is a total load Ft applied to the magnetostrictors 31. Hence, the load F3 is determined to the above-described optimal value Fα.

Accordingly, also in this example, similar to the example shown in FIG. 2, the magnetostrictive actuator 60 can be constantly driven with a desirable magnetostrictive characteristic with a wide magnetic field range, in which a magnetostriction value is linearly changed with respect to a change in controlling magnetic field, and with a large change in magnetostriction value with respect to the change in controlling magnetic field within the magnetic field range, regardless of variations in size and adjustment of magnetostrictive actuators 60 and base casings 20.

Also, in the example, similarly to the example shown in FIG. 2, the coil spring 51 presses the center of the magnetostrictive actuator 60 toward the acoustic diaphragm 10. Accordingly, the axial direction of the magnetostrictive actuator 60 is not inclined with respect to the vertical direction. Vibration with a uniform magnitude in a uniform direction is constantly applied to the acoustic diaphragm 10.

1-4. Other Example

While the examples shown in FIGS. 2 and 5 provide the case in which the screw 52 is inserted as a member for compressing the coil spring 51, a pin-like member may be inserted instead of the screw 52.

In this case, for example, a step or a slope for regulating an insertion position of the member is formed in an inner peripheral surface of the housing 23, or an end of the member is defined as a large-diameter head portion (bottom portion). The components and members are designed and fabricated such that a contraction amount of the coil spring 51 becomes a predetermined amount when the member is inserted into the housing 23 to a position regulated by the step or slope, or to a position at which the head portion contacts a lower surface 22 of the base casing 20, and that the total load Ft becomes the optimal value Fα.

The magnetostrictive actuator 30 or 60 may be provided with a buffer member at the tip end portion of the drive rod 35 so as to reduce wear of the portion of the lower end surface 12 of the acoustic diaphragm 10, the portion contacting the drive rod 35.

The buffer member may be formed into a sheet form and attached to a tip end surface of the drive rod 35 with an adhesive. Alternatively, the buffer member may be desirably mounted on (cover) the tip end portion of the drive rod 35 for easier attachment and detachment on and from the drive rod 35.

If the buffer member has a large thickness, a sound quality may be changed when the buffer member contacts the lower end surface 12 of the acoustic diaphragm 10. Hence, the thickness of the buffer member is determined to several tenths of one millimeter or smaller.

The buffer member may be basically formed of a softer material than materials of the drive rod 35 and the acoustic diaphragm 10 so as to absorb an impact from the drive rod 35 to the acoustic diaphragm 10.

However, if the buffer member is too soft, the buffer member is more deformed when being compressed. Hence, vibration transmitting ability to the acoustic diaphragm 10 is reduced, resulting in a sound pressure being decreased. When the material of the buffer member is softer than the materials of the drive rod 35 and the acoustic diaphragm 10, if the buffer member has hardness with a certain value or higher, adhesion becomes insufficient. Hence, vibration transmitting ability to the acoustic diaphragm 10 is reduced, resulting in a sound pressure being decreased.

Therefore, the material of the buffer member may desirably have a softness (hardness) within a range of from 30 to 75 based on a durometer D, which is a measure of softness (hardness). One of materials having such softness may be ethylene-tetrafluoroethylene copolymer (ETFE), which is a kind of fluoroplastics.

Figure 6:
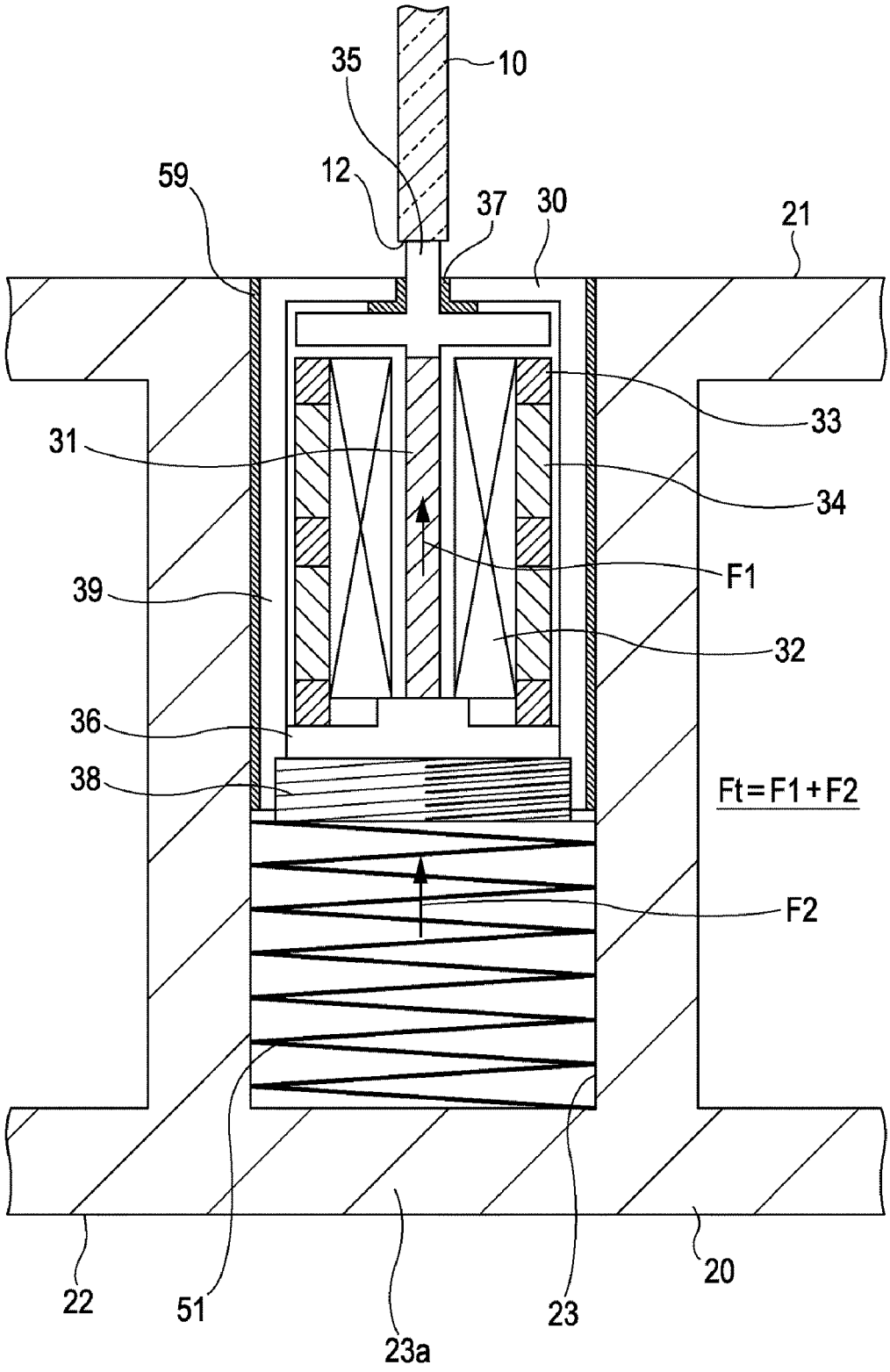
FIG. 6 illustrates a primary portion of a loudspeaker apparatus as a first example according to a second embodiment.
Figure 7:
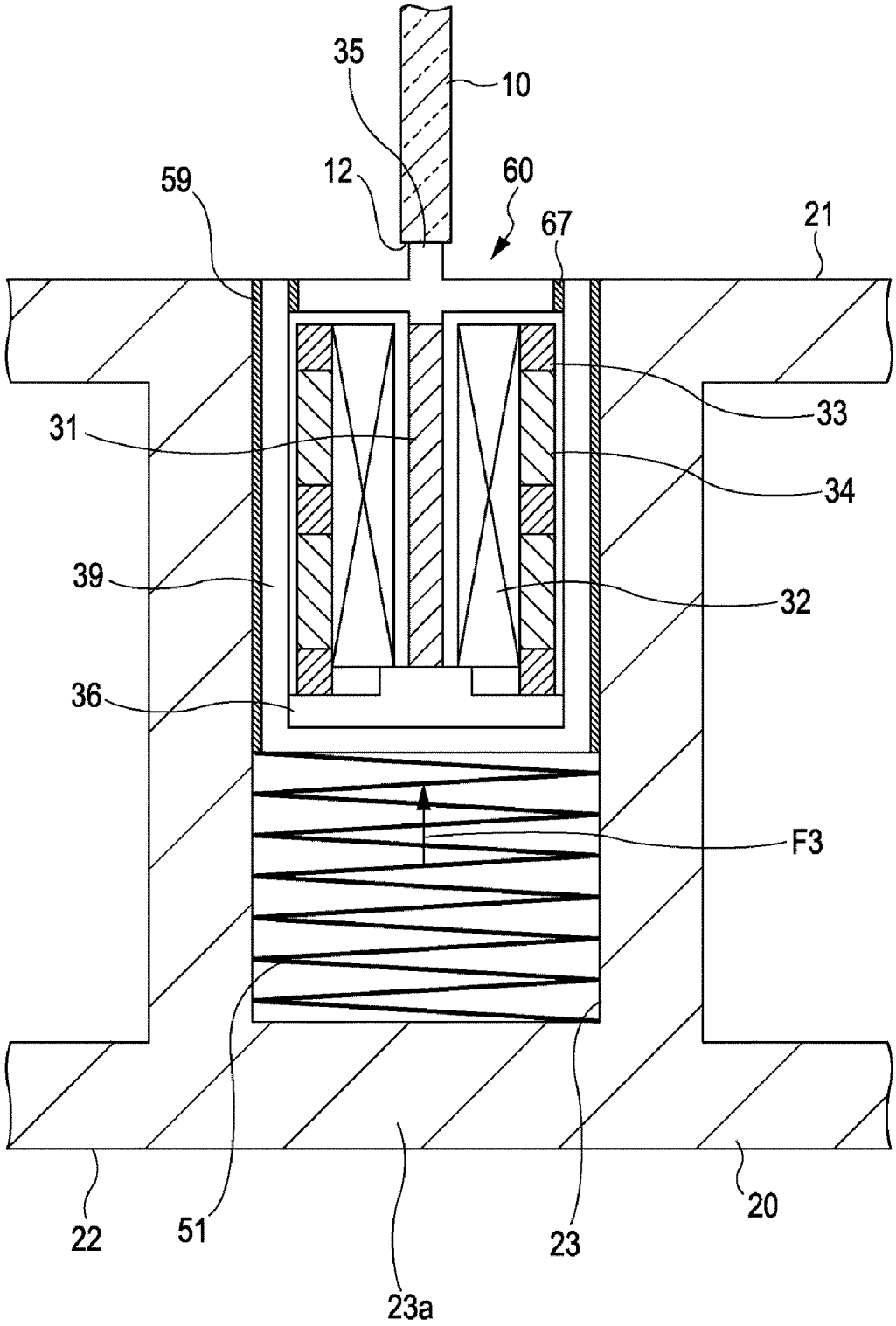
FIG. 7 illustrates a primary portion of a loudspeaker apparatus as a second example according to the second embodiment.
Figure 8:
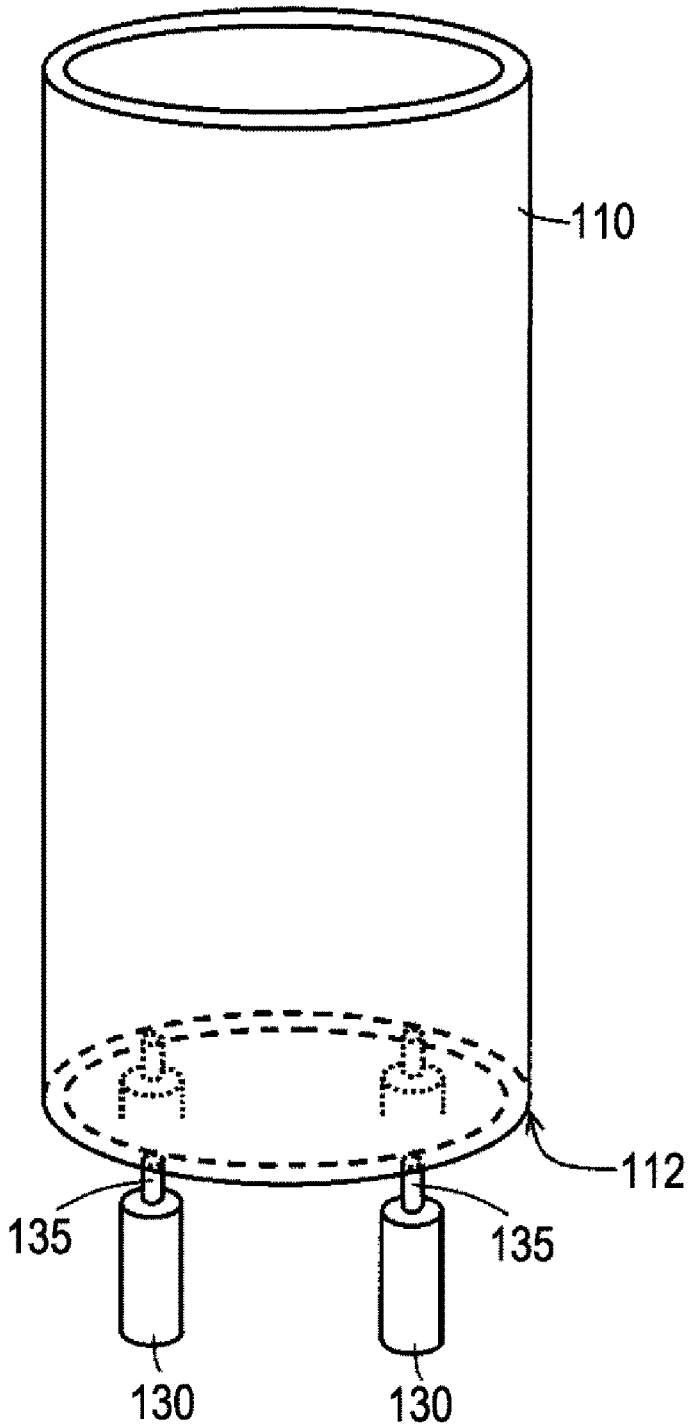
FIG. 8 illustrates an example basic configuration of a loudspeaker apparatus of related art.
Figure 9:
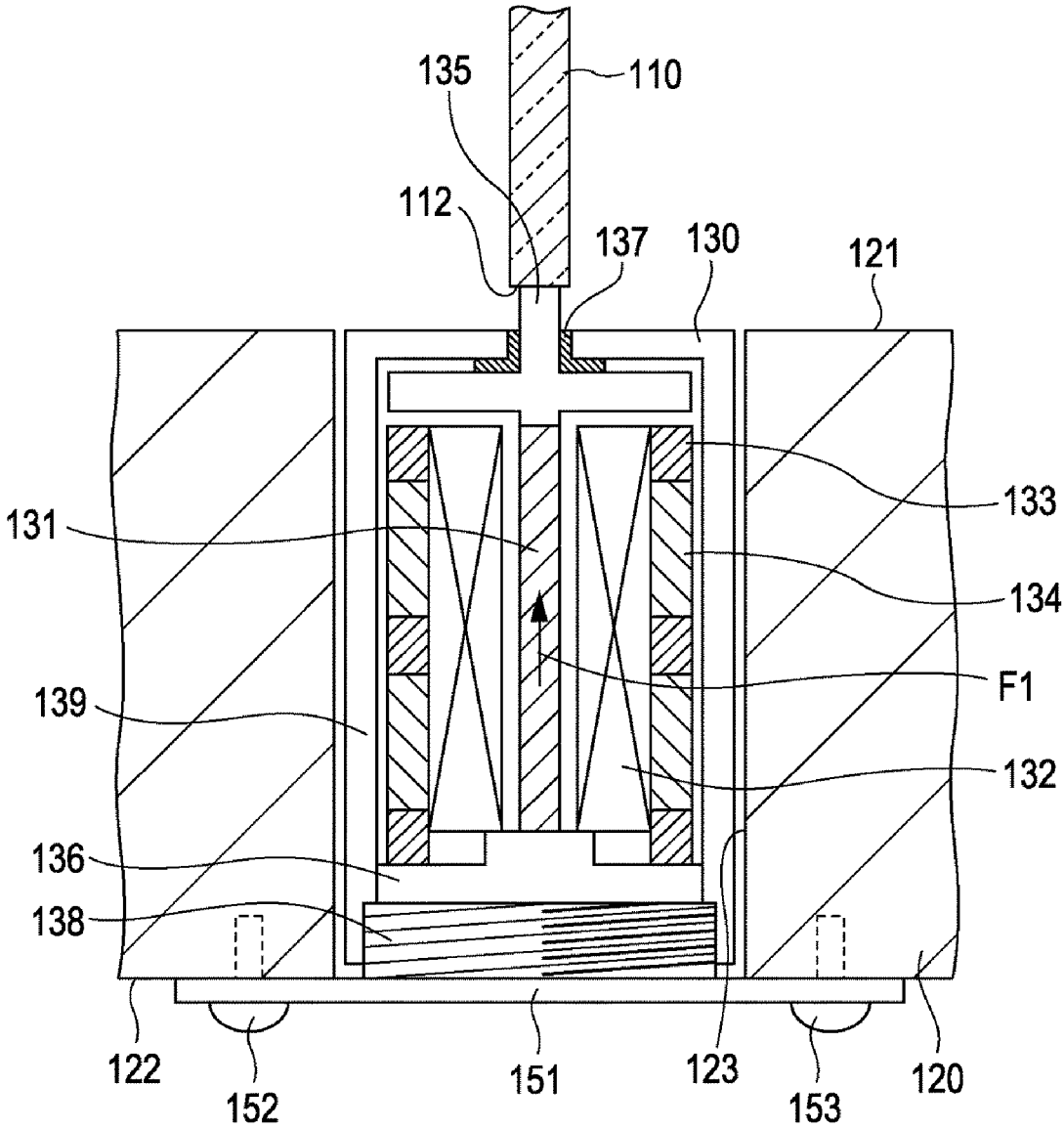
FIG. 9 illustrates an example support structure for a magnetostrictive actuator of the loudspeaker apparatus shown in the example of FIG. 8.

2. Second Embodiment: FIGS. 6 and 7

In the above-described first embodiment, the though hole as the housing 23 is formed in the base casing 20 as the support member. However, a housing, into which a magnetostrictive actuator and a spring (coil spring) are inserted, may be a blind hole (groove) having a bottom portion. This case is described as a second embodiment.

2-1. First Example: FIG. 6

FIG. 6 illustrates a first example according to the second embodiment. The acoustic diaphragm 10 and its support structure are similar to those in the example shown in FIG. 1.

In the example shown in FIG. 6, a blind hole not penetrating through a base casing 20 to a lower surface 22 of the base casing 20 but having a bottom portion 23*a* is formed as a housing 23 in the base casing 20. A coil spring 51 is inserted into the housing 23 from an upper surface 21 of the base casing 20. Also, a magnetostrictive actuator 30 with a preload F1 applied as shown in FIG. 2 is inserted into the housing 23 onto the coil spring 51 in the housing 23.

In this case, while the acoustic diaphragm 10 is not mounted on the base casing 20, the coil spring 51 and the magnetostrictive actuator 30 are inserted into the housing 23, then, the acoustic diaphragm 10 is mounted on the base casing 20 as in the example shown in FIG. 1 such that a tip end of a drive rod 35 of the magnetostrictive actuator 30 contacts a lower end surface 12 of the acoustic diaphragm 10 and the coil spring 51 is compressed.

At this time, the components, such as the magnetostrictive actuator 30 and the base casing 20, and the members, such as the coil spring 51, are designed and fabricated, and then the loudspeaker apparatus is assembled such that a total load Ft (=F1+F2), which is the sum of the preload F1 applied to the magnetostrictor 31 in the magnetostrictive actuator 30 and a load F2 applied to the magnetostrictor 31 by the compressed coil spring 51, becomes the above-described optimal value Fα when the contraction amount of the coil spring 51 becomes a predetermined amount.

Accordingly, also in this example, even when variations in size and adjustment appear among manufactured multiple loudspeaker apparatuses, or among a plurality of magnetostrictive actuators or housings of a single loudspeaker apparatus, or even when a change in size appears due to wear of a portion of the lower end surface 12 of the acoustic diaphragm 10, the portion contacting the drive rod 35, the variations and change are absorbed by a variation in contraction amount of the coil spring 51. The total load Ft (=F1+F2) may fall within the desirable range. The magnetostrictive actuator 30 can be constantly driven with a desirable magnetostrictive characteristic with a wide magnetic field range, in which a magnetostriction value is linearly changed with respect to a change in controlling magnetic field, and with a large change in magnetostriction value with respect to the change in controlling magnetic field within the magnetic field range.

Also, in this example, the coil spring 51 presses the center of the magnetostrictive actuator 30 toward the acoustic diaphragm 10. Accordingly, the axial direction of the magnetostrictive actuator 30 is not inclined with respect to the vertical direction. Vibration with a uniform magnitude in a uniform direction is constantly applied to the acoustic diaphragm 10.

Also in this embodiment, a thin film 59, such as lubricating oil, may be formed or arranged between an outer peripheral surface of the outer casing 39 and an inner peripheral surface of the housing 23 of the base casing 20. The thin film 59 prevents the outer casing 39 and the base casing 20 from directly contacting each other without affecting the driving of the magnetostrictive actuator 30.

2-2. Second Example: FIG. 7

FIG. 7 illustrates a second example according to the second embodiment. The acoustic diaphragm 10 and its support structure are similar to those in the example shown in FIG. 1.

In the example shown in FIG. 7, a blind hole not penetrating through a base casing 20 to a lower surface 22 of the base casing 20 but having a bottom portion 23*a* is formed as a housing 23 in the base casing 20. A coil spring 51 is inserted into the housing 23 from an upper surface 21 of the base casing 20. Also, a magnetostrictive actuator 60 with no preload applied as shown in FIG. 5 is inserted into the housing 23 onto the coil spring 51 in the housing 23.

Herein, the components, such as the magnetostrictive actuator 60 and the base casing 20, and the members, such as the coil spring 51, are designed and fabricated, and then the loudspeaker apparatus is assembled such that a load F3 as a total load Ft applied to the magnetostrictor 31 by the coil spring 51 becomes the above-described optimal value Fα when the contraction amount of the coil spring 51 becomes a predetermined amount.

Accordingly, also in this example, even when variations in size and adjustment appear among manufactured multiple loudspeaker apparatuses, or among a plurality of magnetostrictive actuators or housings of a single loudspeaker apparatus, or even when a change in size appears due to wear of a portion of the lower end surface 12 of the acoustic diaphragm 10, the portion contacting the drive rod 35, the variations and change are absorbed by a variation in contraction amount of the coil spring 51. The total load Ft (=F3) may fall within the desirable range. The magnetostrictive actuator 60 can be constantly driven with a desirable magnetostrictive characteristic with a wide magnetic field range, in which a magnetostriction value is linearly changed with respect to a change in controlling magnetic field, and with a large change in magnetostriction value with respect to the change in controlling magnetic field within the magnetic field range.

Also, in this example, the coil spring 51 presses the center of the magnetostrictive actuator 60 toward the acoustic diaphragm 10. Accordingly, the axial direction of the magnetostrictive actuator 60 is not inclined with respect to the vertical direction. Vibration with a uniform magnitude in a uniform direction is constantly applied to the acoustic diaphragm 10.

3. Other Example or Embodiment

When the acoustic diaphragm is cylindrical as described in the above-described examples, an end or both ends may be closed.

For example, in the example shown in FIG. 1, when the upper end of the acoustic diaphragm 10 is closed, a sound wave is radiated from a bottom portion at the upper end, and hence a sound image becomes widely spread.

The acoustic diaphragm does not have to be a cylinder, and may be a semi-cylinder or an ellipsoidal cylinder. Alternatively, the acoustic diaphragm may be a rectangular cylinder with a cross section perpendicular to a center axis direction being a polygon. Still alternatively, the acoustic diaphragm is not limited to a cylinder, and may be a flat plate.

When the acoustic diaphragm is a flat plate, an end of the acoustic diaphragm may be supported by a support member such as a base casing similar to that of the example shown in FIG. 1 in which the acoustic diaphragm is a cylinder.

Further, the acoustic diaphragm does not have to be a cylinder or a flat plate, and may be a semi-sphere, a sphere, a cone, a pyramid, or a box.

The material of the acoustic diaphragm is not limited to acryl, and may be glass or the like.

It should be understood by those skilled in the art that various modifications, combinations, sub-combinations and alterations may occur depending on design requirements and other factors insofar as they are within the scope of the appended claims or the equivalents thereof.

What is claimed is:

1. A loudspeaker apparatus comprising:

an acoustic diaphragm;

a support member having a housing, which is a hole in a first surface of the support member facing the acoustic diaphragm;

a magnetostrictive actuator having a magnetostrictor and a drive rod coupled to an end of the magnetostrictor, the magnetostrictive actuator being inserted into the housing such that the drive rod contacts the acoustic diaphragm, the magnetostrictive actuator applying vibration to the acoustic diaphragm; and a spring inserted into the housing from a position opposite to a position of the drive rod of the magnetostrictive actuator, the spring pressing the magnetostrictive actuator toward the acoustic diaphragm and applying a load to the magnetostrictor.

2. The loudspeaker apparatus according to claim 1, wherein, in the magnetostrictive actuator, a preload is applied to the magnetostrictor.

3. The loudspeaker apparatus according to claim 1, wherein, in the magnetostrictive actuator, no preload is applied to the magnetostrictor.

4. The loudspeaker apparatus according to claim 1, wherein the housing is a through hole penetrating through the support member to a second surface opposite to the first surface of the support member, and the spring and a member for compressing the spring are arranged in the housing.

5. The loudspeaker apparatus according to claim 4, wherein the member is a screw.

6. The loudspeaker apparatus according to claim 1, wherein the housing is a blind hole not penetrating through the support member to a second surface opposite to the first surface of the support member.

7. The loudspeaker apparatus according to claim 1, wherein the magnetostrictive actuator applies a vibration component to the acoustic diaphragm in at least a direction orthogonal to an end surface of the acoustic diaphragm.

8. The loudspeaker apparatus according to claim 1, wherein the support member has a plurality of holes serving as a plurality of housings, and each of a plurality of magnetostrictive actuators and each of a plurality of springs are respectively inserted into the holes.

* * * * *